United States Patent [19]

Carroll

[11] 3,999,938

[45] Dec. 28, 1976

[54] REVERSIBLE RABBLE TOOTH FOR FURNACES

[75] Inventor: Richard F. Carroll, Arvada, Colo.

[73] Assignee: Sterling Drug Inc., New York, N.Y.

[22] Filed: July 21, 1975

[21] Appl. No.: 597,925

[52] U.S. Cl. ..... 432/239; 432/139; 432/151

[51] Int. Cl.[2] ..... F27D 3/00; F27B 9/18

[58] Field of Search ..... 432/139, 151, 239

[56] References Cited

UNITED STATES PATENTS

| | | | |
|---|---|---|---|
| 670,597 | 3/1901 | Powers | 432/151 |
| 1,484,791 | 2/1924 | Leggo | 432/239 |
| 1,736,769 | 11/1929 | Connolly | 432/139 |

*Primary Examiner*—John J. Camby
*Attorney, Agent, or Firm*—Charles R. Fay

[57] ABSTRACT

An insertable and reversible rabble tooth for the rabble arms of furnaces including specially shaped wedges to clamp the rabble teeth to the rabble arm in either in hearth condition or in out hearth condition by reversing the positions of the wedges and reversing the positions of the teeth held by the wedges.

14 Claims, 7 Drawing Figures

REVERSIBLE RABBLE TOOTH FOR FURNACES

BACKGROUND OF THE INVENTION

Inserted rabble teeth for furnaces are old and well-known in the art, but the mounting areas for the rabble teeth on the rabble arms are made in two different styles, one for in hearth operation and one for out hearth operation, whereby the angles of the scraping blades are changed. It is the object of the present invention to provide a construction wherein the same rabble tooth may be used in either condition.

SUMMARY OF THE INVENTION

The rabble arm is provided with an elongated dovetailed face and in this dovetail there are inserted by sliding from one end, for instance, new and improved special wedges which are adapted to clamp the mounting areas of the rabble teeth. These wedges are made with V-shaped faces facing each other to clamp the mounting areas of the rabble teeth between the same, and they are backed and held in place by spacer blocks also slidable in the dovetail.

These wedges are mirror images of each other and the inclined edges of the V-structure are at different angles and have different lengths for the purpose of using a pair of wedges to accommodate the special new and improved mounting areas of the rabble teeth. The V-structures or recesses that are asymmetrical in the direction of rotation of the rabble arms, but are symmetrical with respect to the desired angle of the scraper portions of the rabble teeth.

The mounting areas of the rabble teeth are made in a symmetrical multitrapezoidal shape with angular sloping surfaces on four sides and two opposing sides that are flat. The angular sides are parallel to opposite sides and create two sets of male dovetail sections. This mounting area fits into the recess between a pair of wedges described, and these wedges may be positioned so that the scraper blade may be mounted at two different angles with relation to the longitudinal axis of the rabble arm, for either in or out hearth operation.

PREFERRED EMBODIMENT OF THE INVENTION

Figure 1:
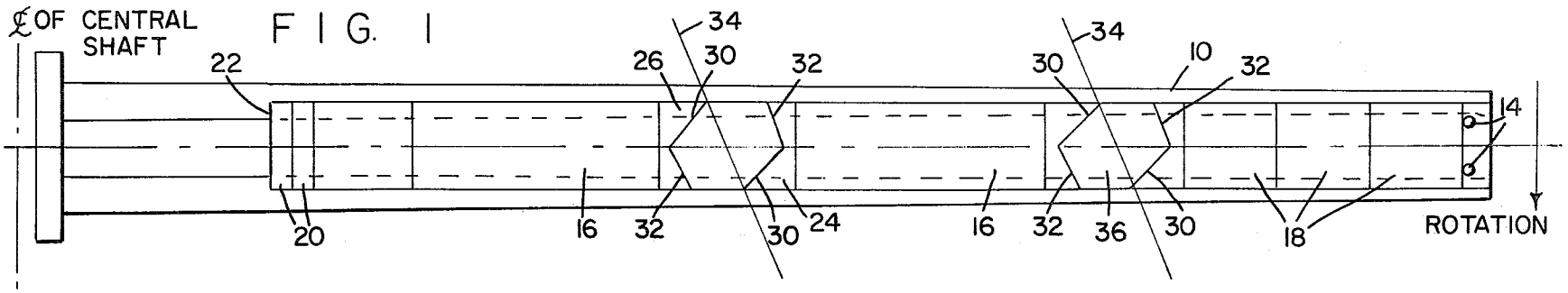
FIG. 1 is a plan view of a rabble arm showing the scraper blades in in hearth condition, there being two teeth shown.

The rabble arm 10 is provided with an undercut dovetail 12 extending for the major portion of the length thereof. There are a couple of removable pin stops at 14 and there are various spacer blocks as shown at 16, 18 and 20 for instance, which have male dovetails thereon and which are held between a shoulder 22 adjacent to the rabble shaft, not shown, and the pins 14.

There are a pair of wedges 24 and 26 for each rabble tooth to be held, and these wedges are generally V-shaped, having adjacent edges or surfaces as at 30, 32. These V-shaped surfaces are relatively speaking mirror images in pairs, each wedge having a long edge 30 at a certain angle with respect to the longitudinal axis of the rabble arm, and another surface 32 that is shorter and at a greater angle with respect to the axis of the rabble arm axis.

The scraper blades of the rabble teeth are indicated at 34, these blades preferably tapering down from a maximum at the mounting area 36 to the scraping edge.

Figure 4:
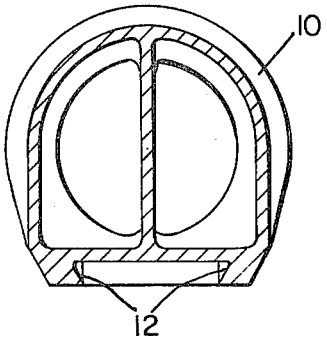
FIG. 4 is a sectional view through the rabble arm.
Figure 5:
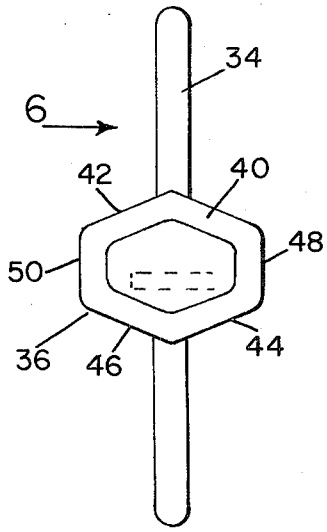
FIG. 5 is a plan view of the new rabble tooth.
Figure 6:
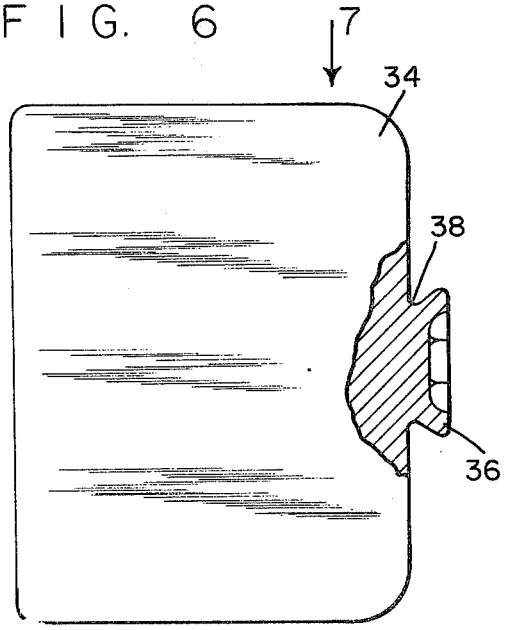
FIG. 6 is a side view looking in the direction of arrow 6 in FIG. 5.
Figure 7:
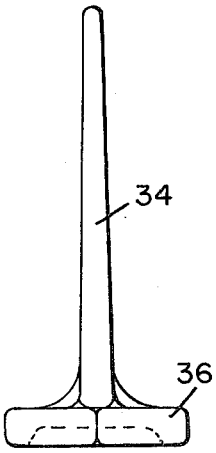
FIG. 7 is an edge view looking in the direction of arrow 7 in FIG. 6.

As shown in FIG. 5 the mounting area is in a plane at right angles to the scraper blade and is undercut as shown at 38 to be slidably received in the dovetail 12 as shown in FIG. 4, on the rabble arm 10. Each mounting area 36 is six sided and these sides are indicated at 40, 42, 44, 46, 48 and 50. The sides 40 and 42 are on an inverted wide angle V-shaped construction, opposite to similar but reversed sides 44 and 46, and the sides 40 and 44 are spaced by a straight flat side 48 opposite to a similar flat side 50. The side 40 is parallel to the side 46; the side 44 is parallel to the side 42.

Figure 2:
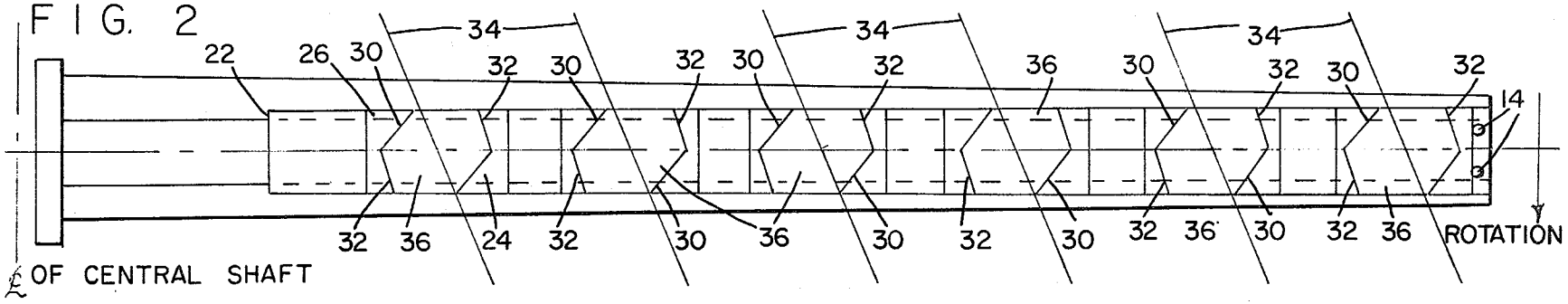
FIG. 2 is a similar view but illustrates that a greater number of teeth may be inserted in the same rabble arm with the use of different spacer blocks.
Figure 3:
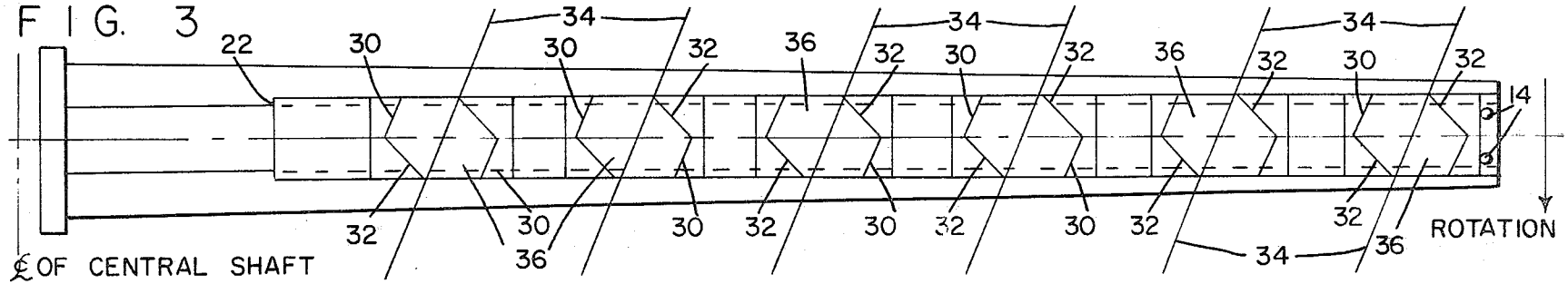
FIG. 3 is a view similar to FIG. 2 but showing the arrangement of the blades for out hearth operation.

It will be seen, therefore, looking at FIGS. 1, 2 and 3 that the holding wedges 24 and 26 form a holding recess or the like for the mounting area 36 of the rabble tooth holding the blade 34 at an angle with the trailing end to the left as seen in the drawing. However, upon reversing the wedges as shown in FIG. 3, the rabble tooth is then reversed so that the blades have their trailing ends to the right.

It is therefore, clear that the present rabble teeth, although all being exactly alike, can be arranged on a rabble arm with the angle of the scraper blade in either direction for either in hearth or for out hearth operation. This is because recesses formed by the wedges are symmetrical with respect to a central plane passing through the blade are asymmetrical with respect to the direction of rotation and to planes at right angles to the axis of the rabble arm.

Convenient spacers are used to equally space the pairs of wedges as an inspection of FIGS. 1, 2 and 3 shows.

I claim:

1. The combination of an elongated free-ended rabble arm with like inserted reversible rabble teeth, wherein the rabble arm includes rabble tooth clamping means comprising reversible wedges, each rabble tooth comprising a scraper blade portion and a mounting portion, each mounting portion being substantially flat and transverse to its blade, extending to each side of the blade, the mounting portions being generally symmetrical at each side of the blade but asymmetrical relative to the width of the rabble arm, said mounting portion being accepted and held by the rabble tooth clamping wedges on the rabble arm in at least two different positions upon reversal of the rabble tooth clamping wedges and reversal of the rabble tooth mounting portions in conformance thereto, whereby the scraper blade portion of the rabble tooth is set and held at two different inclinations relative to the rabble arm.

2. The combination of claim 1 wherein said rabble tooth clamping means on the rabble arm forms a recess which corresponds to the shape and the area of the rabble tooth mounting portion.

3. The combination of claim 1 wherein the rabble tooth clamping wedges include facing recessed surfaces.

4. The combination of claim 3 wherein said facing recessed surfaces are V-shaped.

5. The combination of claim 4 wherein each V-shaped surface of each wedge is provided with a long edge and a short edge, the long edges being opposed and generally parallel and the short edges also being opposed and generally parallel.

6. The combination of claim 5 wherein said wedges are insertable and removable from the rabble arm.

7. The combination of claim 6 wherein the rabble arm is provided with an undercut dove-tail and the wedges and the mounting portion of the rabble tooth have corresponding undercuts with respect to said dove-tail for slidable reception on the rabble arm.

8. The combination of claim 1 wherein the mounting portion of the rabble tooth comprises projections extending oppositely from the sides of the scraper blade portion thereof, and are trapezoidal in shape.

9. The combination of claim 8 wherein said trapezoidal projections are accommodated by the rabble tooth clamping wedges on the rabble arm, the said clamping wedges conforming in shape to the multi-trapezoidal mounting portion of the rabble tooth.

10. The combination of claim 1 wherein said rabble teeth are slidable along the length of said rabble arm.

11. The combination of claim 10 wherein the rabble teeth are slidably removable from the free end of the rabble arm.

12. The combination of claim 11 wherein said wedges are also slidable along the rabble arm, said wedges being removable and replaceable from the free end thereof.

13. The combination of claim 12 including means for holding said rabble teeth and the wedges in fixed position on the rabble arm.

14. The combination of claim 13 wherein the rabble arm is undercut along its length from the free end thereof inwardly and edges of the rabble teeth mounting portions and wedges are slidingly received therein.

* * * * *